US007757967B1

(12) United States Patent
Yang

(10) Patent No.: US 7,757,967 B1
(45) Date of Patent: Jul. 20, 2010

(54) PROTECTION COVER DEVICE FOR FIRE-FIGHTING/PROTECTION INSTRUMENTS

(75) Inventor: Su Yang, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 11/761,779

(22) Filed: Jun. 12, 2007

Related U.S. Application Data

(60) Provisional application No. 60/804,549, filed on Jun. 12, 2006.

(51) Int. Cl.
*B05B 1/28* (2006.01)
*B65D 85/42* (2006.01)
*B65D 41/00* (2006.01)
*A62C 37/08* (2006.01)

(52) U.S. Cl. ..... 239/288; 206/418; 220/724; 169/37

(58) Field of Classification Search ..... 206/349, 206/538, 521, 528, 418; 239/288, 288.3, 239/288.5; 220/724, 4.23, 4.24, 4.25; 169/37
See application file for complete search history.

(56) References Cited

U.S. PATENT DOCUMENTS 6,098,256 A * 8/2000 Poussard ..... 24/704.1
6,669,111 B2 * 12/2003 Vinson et al. ..... 239/288
D498,818 S 11/2004 Ide et al.
7,273,189 B2 * 9/2007 Ide et al. ..... 239/288
2005/0035022 A1 * 2/2005 Ide et al. ..... 206/528

OTHER PUBLICATIONS

UL Standard 1626 (Oct. 2003) entitled "Residential Sprinklers for Fire-Protection Service UL-1626", pp. 41-42A.
UL Standard 199 (Nov. 4, 2005) entitled "Automatic Sprinklers for Fire-Protection Service UL-199", pp. 23-25.
UL Standard 2351 (Jun. 4, 2004) entitled Spray Nozzels for Fire-Protection Service UL-2351, pp. 26-28.
U.S. Appl. No. 29/280,987, filed Jun. 12, 2007, Su Yang.
Product 1 Sprinkler Cover (photographs); 3 pages, Product marked Patent Pend., pp. 2 and 3 of 3.
Product 2 Sprinkler Cover (photographs); 6 pages, Product marked "US Patent No. 6669111", p. 4 of 6.
Product 3 Sprinkler Cover (photographs); 6 pages, Product marked "US Patent No. 6669111", p. 4 of 6.
Product 4 Sprinkler Cover (photographs); 5 pages, Product marked "US Patent No. 6669111", p. 3 of 5.

* cited by examiner

*Primary Examiner*—Dinh Q Nguyen
*Assistant Examiner*—Justin Jonaitis
(74) *Attorney, Agent, or Firm*—Perkins Coie LLP

(57) ABSTRACT

A protection device for a fire-fighting/protection instrument and its operational components. The device includes a proximal end surface and a distal end surface with a wall member extending therebetween having an outer surface and an inner surface. The proximal and distal end surfaces define a chamber with the wall member for housing at least a portion of the instrument. The wall member includes a first portion and a second portion defining at least one pivot axis therebetween. At least one of the first and second portions further defines a core element disposed between a first lateral member and a second lateral member. The inner surface of the device includes a plurality of projections for supporting the instrument in the chamber.

20 Claims, 12 Drawing Sheets

PROTECTION COVER DEVICE FOR FIRE-FIGHTING/PROTECTION INSTRUMENTS

PRIORITY DATA AND INCORPORATION BY REFERENCE

This application claims benefit of priority to U.S. Provisional Patent Application No. 60/804,549, filed Jun. 12, 2006 which is incorporated by reference in its entirety.

TECHNICAL FIELD

This invention relates generally to protection devices for fire-fighting/protection instruments. More specifically, the present invention is directed to a protective cover device to protect the operational components or trigger assembly of the instrument having either a link configuration or a bulb type assembly.

BACKGROUND OF THE INVENTION

Automatic fire protection systems are one of the most widely used applications for fire protection. These system applications utilize fire fighting/protection instruments such as, for example, sprinklers and/or spray nozzles that are activated once the ambient temperature in an environment, such as a room or a building, exceeds a predetermined or threshold value. Once activated, the sprinklers and/or nozzles distribute fire-extinguishing fluid, preferably water, in the room or building.

In order to properly respond to the ambient threshold value, automatic sprinklers and nozzles are provided with a thermally responsive trigger assembly. These trigger assemblies support in place a closure member at the discharge outlet of the instrument. Once the threshold temperature is reached in the room or enclosure, the trigger assembly actuates and displaces the closure member allowing fire fighting fluid such as water to discharge from the outlet of the instrument. One type of trigger assembly is a fusible link as provided in an automatic sprinkler. The fusible link includes a link member having two halves in which a solder element holds the halves in place to support the closure member at the sprinkler outlet. The solder member is thermally rated to melt at a threshold temperature thus, allowing the halves to separate and displace the closure member for sprinkler operation. Another type of trigger assembly includes a bulb type trigger assembly provided in an automatic spray nozzle or automatic sprinkler. The bulb type trigger assembly includes a fluid contained within a glass bulb that supports the closure assembly at the sprinkler outlet. The fluid expands upon exposure to heat and at a sufficiently high temperature. The fluid can expand so as to shatter the glass bulb. Once the bulb shatters, the closure member can be displaced to allow for fluid discharge from the sprinkler outlet.

The trigger assemblies for automatic sprinklers and spray nozzles are generally fragile and can be subject to damage during shipping, storage and/or installation. For example, the trigger assembly in a sprinkler mounted to a branch pipe of a sprinkler system can be damaged by building materials such as, for example, dry wall, pipe or other obstructions that are moved about during construction. In addition, the trigger assemblies can be damaged when mishandled or dropped by an installer. When the trigger assembly is damaged, the entire sprinkler or nozzle generally must either be discarded and/or replaced which can be a significant cost to the manufacturer, supplier, installer and/or building owner.

To protect the trigger assembly during shipping and/or installation a cover or protection device can be disposed about the sprinkler such that the trigger assembly is shielded from damage. One known protector is shown and described in U.S. Pat. No. 6,669,111, which is directed to a protector for a thermally responsive member of a sprinkler head. Shown is a protector that pivots or separates about a hinge to envelop the frame arms of the sprinkler. Another protector is shown in Design Patent No. D498,818 and is more specifically directed to a bulb cover.

In October 2003, Underwriter's Laboratories, Inc. ("UL") published UL Standard 1626 (October 2003) entitled "*Residential Sprinklers For Fire-Protection Service UL*-1626" (hereinafter "UL 1626") which included Section 35A directed to impact test for protective covers. Section 35A is incorporated in its entirety by reference. The test of Section 35A established acceptable performance criteria for protective covers or devices configured to protect frangible bulb type sprinklers. According to the test, a frangible bulb type sprinkler with a protective cover installed shall not be damaged or leak when tested in manner outlined by Section 35A.2. The test of Section 35A was made effective Mar. 26, 2004. Similar impact test standards are established for commercial sprinklers in UL Standard publication "Automatic Sprinklers For Fire-Protection Service—UL 199" (Nov. 4, 2005) (hereinafter "UL 199"). Section 21 of UL 199 specifically provides standards and criteria for conducting an impact test for a protective cover substantially similar to those of UL 1626, Section 35A. The test of UL 199 Section 21 was made effective Sep. 26, 2004 and is incorporated in its entirety by reference. Another, but substantially similar test is provided for spray nozzles, in UL Standard 2351 entitled, "Spray Nozzles For Fire-Protection Service—UL 2351" (Jun. 4, 2004) (hereinafter "UL 2351"), which is incorporated herein in its entirety by reference. Section 30 of UL 2351, effective Dec. 4, 2005, specifically provides standards and criteria for conducting an impact test for a protective cover installed over a glass bulb type automatic nozzle. Accordingly, any sprinkler cover protection device supplied after Mar. 26, 2004 needs to comply with the impact standards of preferably UL 1626, Section 35A; UL 199, Section 21 and/or UL 2351, Section 30.

SUMMARY OF THE INVENTION

In one aspect of the present invention, provided is a protective cover device for a fire fighting instrument preferably including a proximal end and a distal end spaced from the proximal end along a longitudinal axis. The proximal end includes a proximal end surface substantially orthogonal to the longitudinal axis, and the distal end preferably includes a distal end surface substantially orthogonal to the longitudinal axis. The device further includes a wall member having an outer surface and an inner surface circumscribed about the longitudinal axis. The inner surface of the wall member is preferably contiguous with at least a portion of the proximal end surface and the distal end surface so as to define a chamber for housing at least a portion of the instrument.

The wall member further includes a first portion, a second portion defining one or more pivot axes therebetween. The inner surface preferably includes a plurality of projections for supporting the instrument in the chamber. Preferably each of the first and second portions comprise a core element, the core element of the first portion defining a first curved wall curved about a first central axis of curvature, and the core element of the second portion defining a second curved wall about a second central axis curvature.

In another preferred embodiment of the protection device, for a fire protection instrument, the protection device includes a proximal end and a distal end spaced from the proximal end along a longitudinal axis. The device includes a wall member having an outer surface and an inner surface circumscribed about the longitudinal axis. The wall member including a first portion and a second portion defining at least one pivot axis therebetween. The inner surface includes a plurality of projections for supporting the instrument in the chamber, at least one of the first and second portions further defines a core element disposed between a first lateral member and a second lateral member. The proximal end includes a proximal end surface contiguous with at least one the first and second portions of the wall member, and the distal end includes a distal end surface contiguous with at least one the first and second portions of the wall member. The proximal and distal end surfaces radially extend in the direction of the longitudinal axis so as to define a chamber with the wall member for housing at least a portion of the instrument.

In another preferred embodiment, a fire protection system includes an instrument having a deflector and a body axially spaced from the deflector along an instrument axis. The instrument body includes a pair of frame arms disposed about the instrument axis, and a trigger assembly disposed between the frame arms. A protective device is disposed about the trigger assembly. The device includes a wall member having an outer surface and an inner surface circumscribed about the instrument axis. The wall member includes a first portion and a second portion defining at least one pivot axis therebetween. The inner surface includes at least two projections engaged with a portion of the frame arms so as to substantially prevent relative movement between the protective device and the instrument. At least one of the first and second portions of the wall member further define a core element disposed between a first lateral member and a second lateral member. A proximal end surface is contiguous with at least one the first and second portions of the wall member. A distal end surface is contiguous with at least one the first and second portions of the wall member. The first and second proximal end surfaces radially extend in the direction of the longitudinal axis so as to define a chamber with the wall member for housing at least a portion of the trigger assembly.

Another preferred embodiment according to the present invention provides a method of protecting a fire-fighting instrument having a frame and a trigger assembly disposed within the frame. The preferred method includes disposing a protective device having a wall member including a first portion and a second portion, the wall member having an inner surface about the trigger assembly. The method further includes engaging a plurality of projections disposed along the inner surface with a portion of the frame of the instrument so as to substantially eliminate relative movement between the protective device and the instrument; and radially extending a proximal surface and a distal surface from the wall member toward the trigger assembly so as to house the trigger assembly within a chamber.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION

Figure 7:
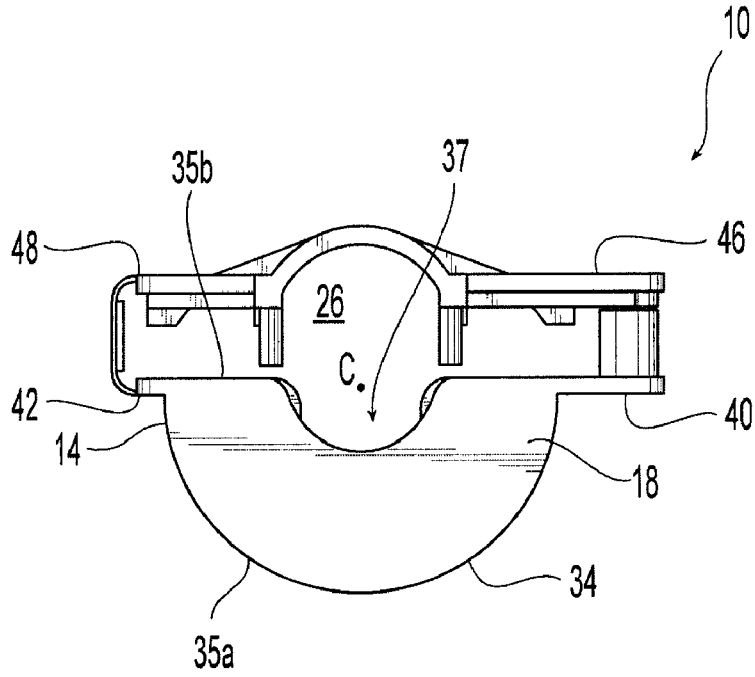
FIG. 7 is a bottom view of the device of FIG. 1.
Figure 8:
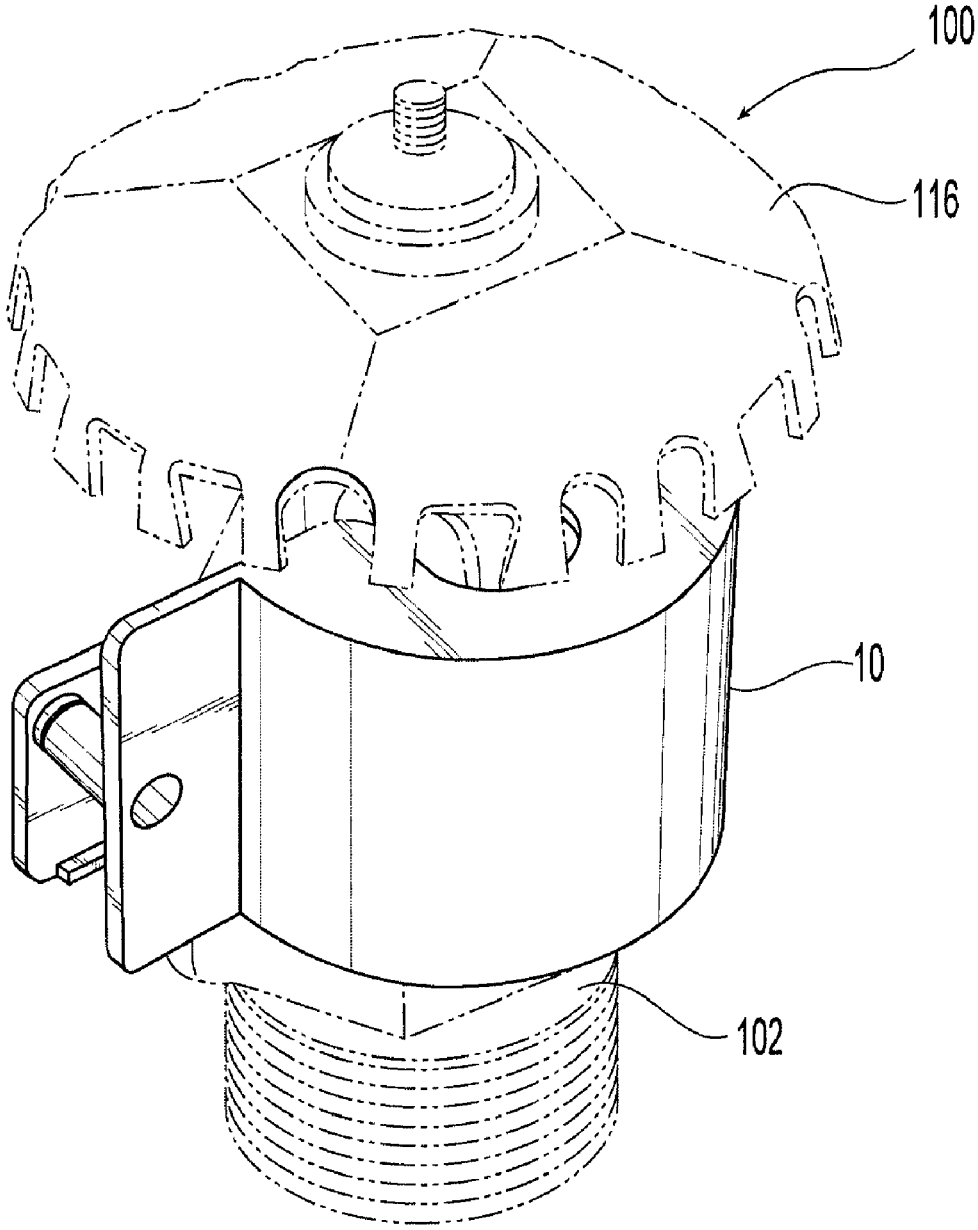
FIG. 8 is a perspective view of the device of FIG. 1 disposed about an illustrative upright-type sprinkler.
Figure 8A:
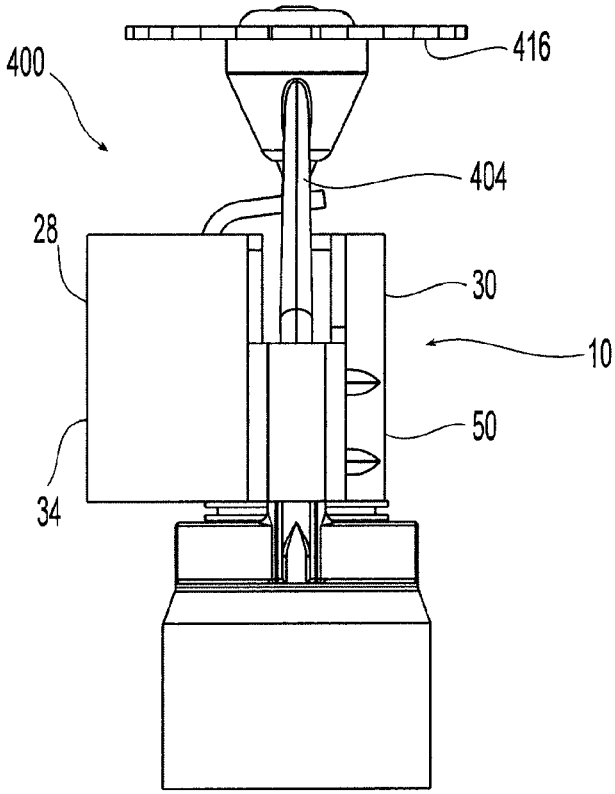
FIGS. 8A-8D are various views of the device of FIG. 1 disposed about an illustrative pendent-type sprinkler.
Figure 8B:
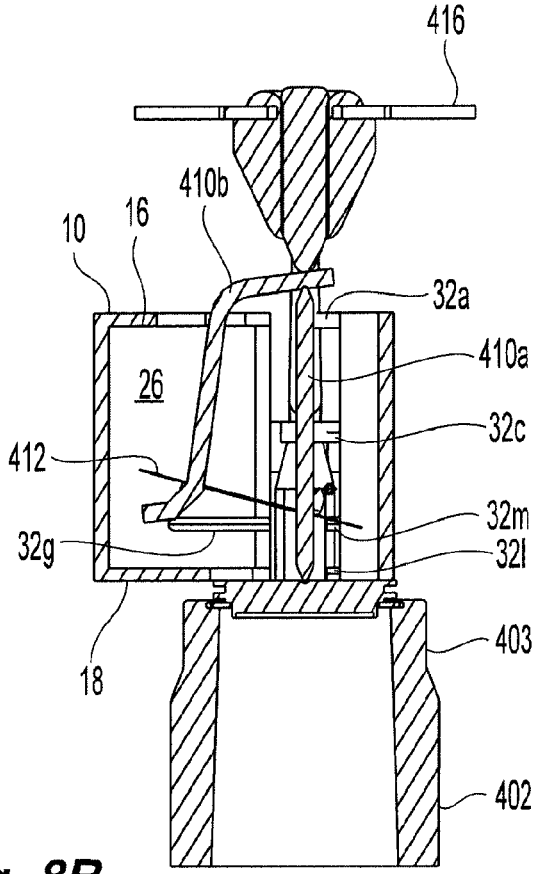
Figure 8C:
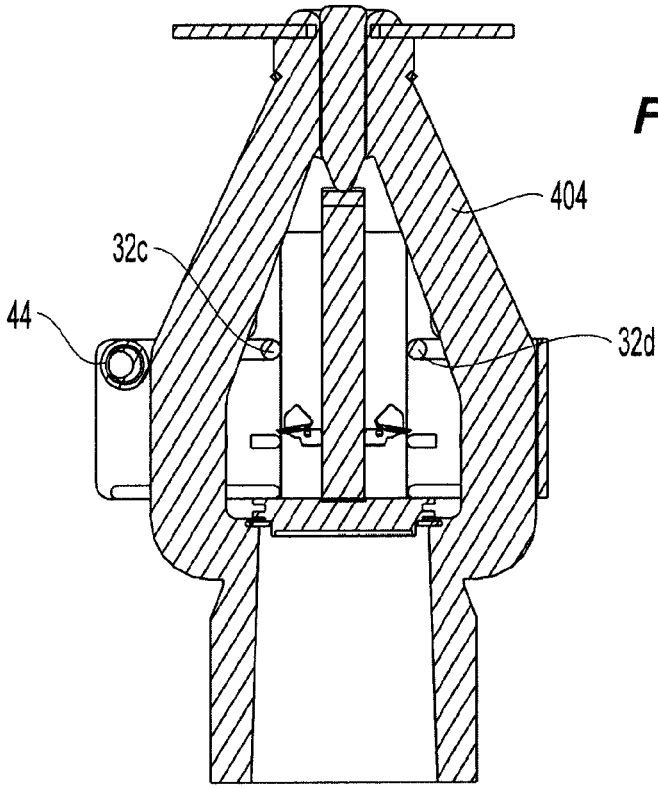
Figure 10:
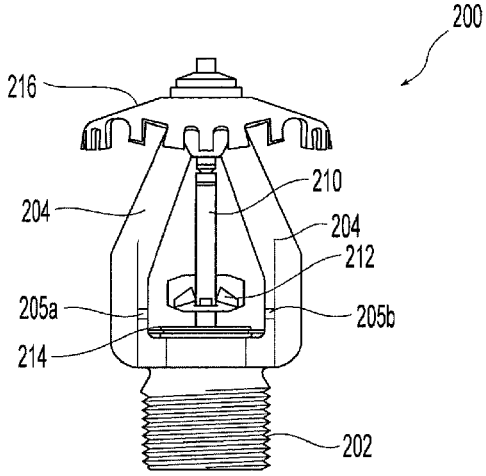
FIG. 10 is an illustrative plan view of an upright-type sprinkler for use with the device of FIG. 1
Figure 11:
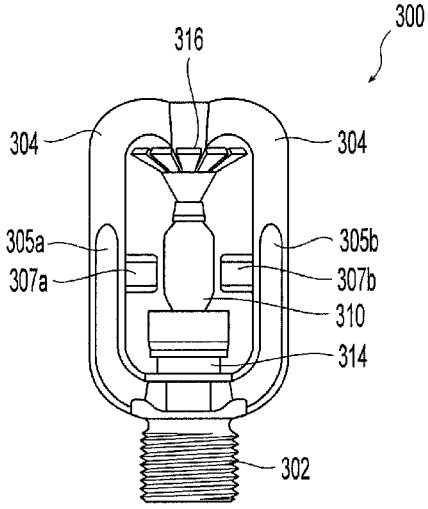
FIG. 11 is an illustrative plan view of a spray nozzle for use with the device of FIG. 1.

FIGS. 1-9 provide illustrative embodiments of a preferred protective cover device 10, 10' for the protection of a fire-fighting/protection instrument. Shown in particular in FIG. 8, is the device 10 disposed about an exemplary automatic fire-fighting instrument 100, shown as an automatic sprinkler, to protect the operational components of the sprinkler 100. The device 10 is shown disposed about an upright sprinkler; however, the device 10 is preferably configured to be disposed about sprinklers and/or spray nozzles of varying configuration such as, for example, an upright-type sprinkler 200 of FIG. 10, spray nozzle 300 of FIG. 11, and pendent-type sprinkler 400 of FIGS. 8A-8D. One type of bulb type instrument for use with the device 10 is shown in product datasheet TFP800 from Tyco Fire & Building Products entitled "Type EA-1 PROTECTOSPRAY: Directional Spray Nozzles, Automatic Medium Velocity" (April 2006) which is incorporated by reference in its entirety. Another type of instrument for use with the device 10 is a fusible link type sprinkler shown in product datasheet TFP213 from Tyco Fire & Building Products entitled "Model EC-25: Extended Coverage Area Density Sprinklers—25.2 K-factor" (September 2004) which is incorporated by reference in its entirety. Other type of fire-fighting/protection instruments for use with the protective cover device 10 include, for example, the early suppression fast response pendant sprinklers available from Tyco Fire & Building Products for which the datasheets: TFP312 (January 2005) entitled "*Model ESFR*-25*: Early Suppression Fast Response Sprinklers* 25.2 *K-Factor*"; TFP315 (January 2005) entitled "*Model ESFR*-17*: Early Suppression Fast Response Sprinklers* 16.8 *K-Factor*"; and TFP318 (July 2004) entitled "*Model ESFR*-1*: Early Suppression Fast Response Sprinklers* 14.0 *K-Factor*," each of which is incorporated herein in their entirety by reference.

Figure 1:
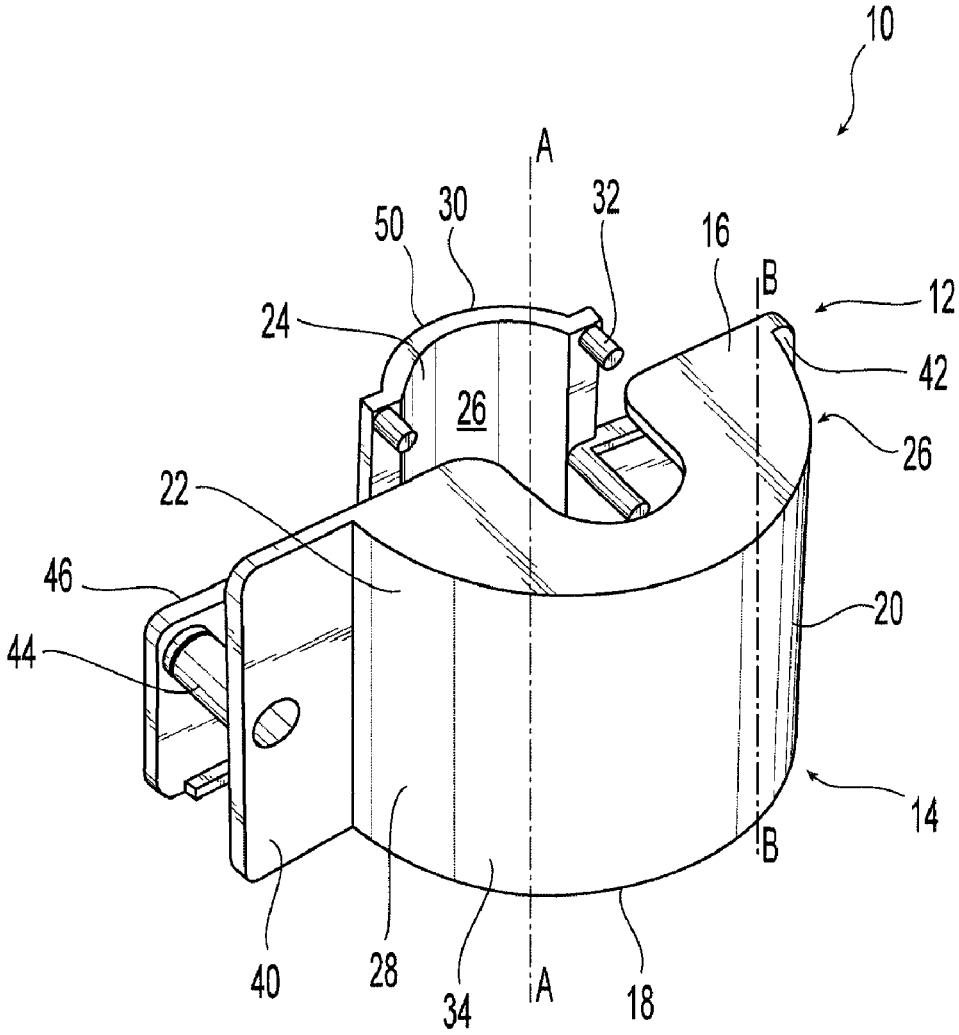
FIG. 1 is a perspective view of a preferred embodiment of a protective cover device.

Referring now in particular to FIG. 1, the device 10 is preferably a fabricated body member configured to be disposed about the frame work of the instrument 100 so as to preferably protect the trigger assembly and/or other operational components of the instrument. The device 10 generally includes a proximal end 12 and a distal end 14 spaced apart along a longitudinal axis A-A. The device 10 further preferably includes a wall member 20 having an outer surface 22 and an inner surface 24. The proximal end 12 of the device 10 preferably includes a proximal end surface 16 extending from the wall member in the direction of the longitudinal axis A-A. The proximal surface 16 preferably extends substantially orthogonally to the longitudinal axis A-A. Preferably spaced from the proximal end surface 16 is a distal end surface 18. The distal end surface 18 also extends from the wall member in a direction toward the longitudinal axis A-A, preferably substantially orthogonally.

The inner surface 24 is preferably substantially circumscribed about the longitudinal axis A-A. The inner surface 24 of the wall member 20 is further preferably contiguous with at least a portion of the proximal end surface 16 and the distal end surface 18 so as to define a chamber 26 for housing at least a portion of a fire-fighting/protection instrument. More specifically, the wall 20 and the end surfaces 16, 18 define the protective housing for the operational components of the fire-fighting/protection instrument such as, for example, the closure assembly and trigger assembly, i.e., a fusible link or a bulb type trigger assembly.

The wall member 20 further preferably includes a first portion 28, and a second portion 30. The device 10 is preferably configured so that the first portion 28 can pivot with respect to the second portion 30. In one preferred embodiment of the preferred protective device 10, the first portion 28 can pivot with respect to the second portion 30 about a pivot axis B-B defined by a hinge located between the first portion 28 and the second portion 30 as shown, for example, in FIGS. 1, 1A. Even more preferably, the device 10 includes a second pivot axis B'-B' spaced from the axis B-B with a panel portion 21 of the wall member 20 disposed therebetween, as shown for example, in FIG. 1A. Accordingly, the first portion 28 and the second portion 30 can pivot with respect to one another and the panel portion 21. Where the device is made from a polymer or plastic such as, for example, polypropylene or polyethylene, preferably one or more living hinges can be formed between the first portion 28 and the second portion 30. Accordingly, the device 10, can be constructed from two hinged panels configured to pivot with respect to one another about one or more parallel axes, provided the panels form at least a partial chamber in which to house the operational components of a fire-fighting/protection instrument. Preferably the device 10 can be molded, preferably injected modeled, as a unitary construction using a polymer material such as, for example, High Density Polyethylene (HDPE) material.

Figure 1A:
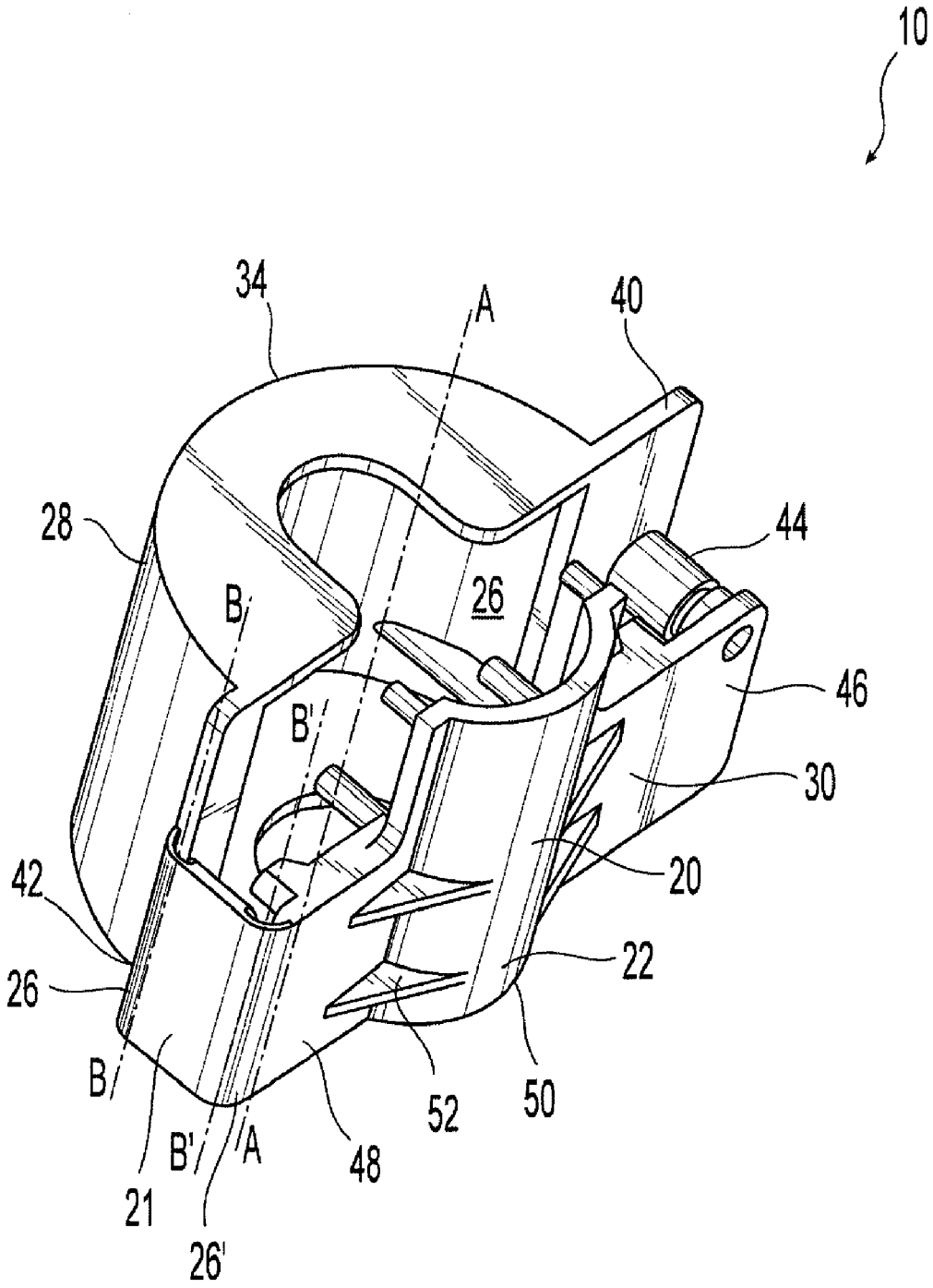
FIG. 1A is an alternate perspective view of the device of FIG. 1.
Figure 2:
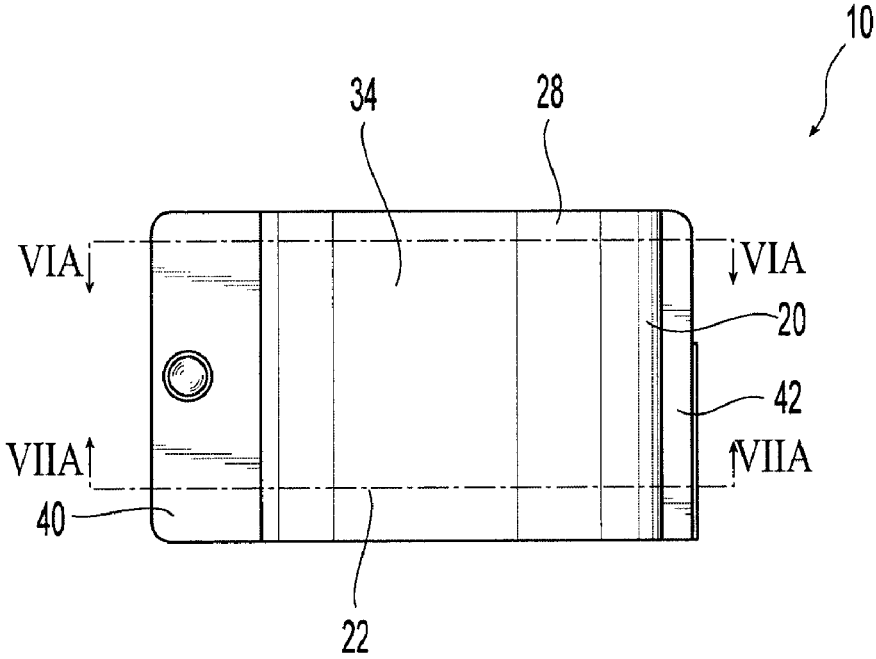
FIG. 2 is a plan view of the left side of the device of FIG. 1.
Figure 9:
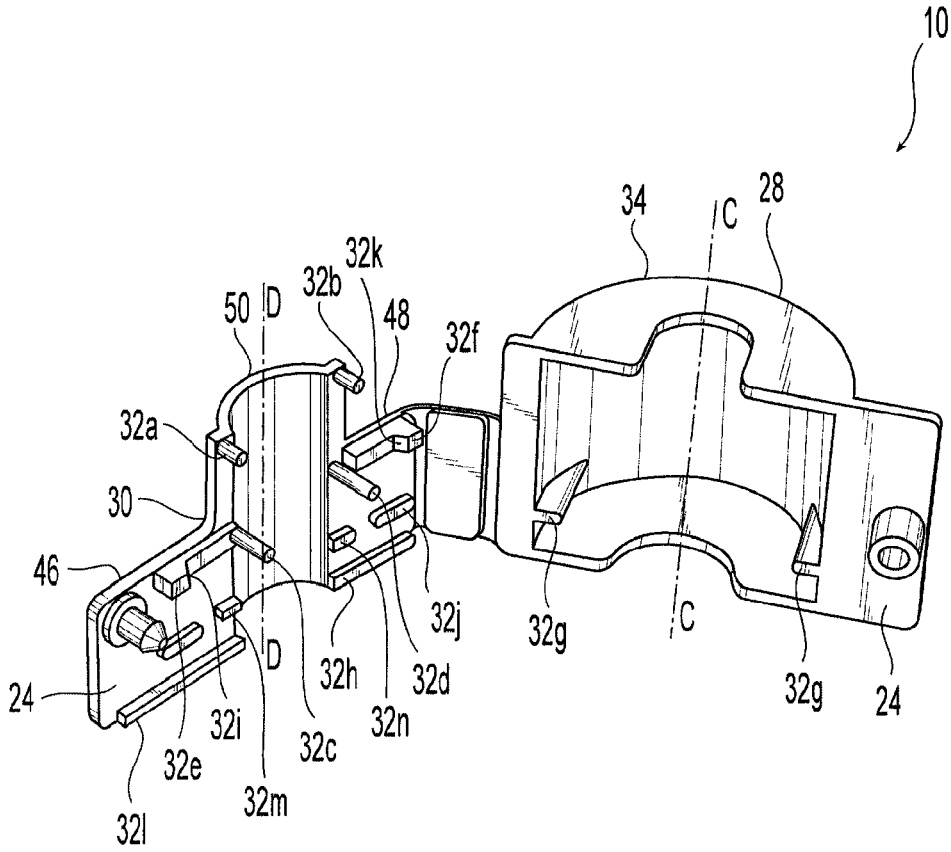
FIG. 9 is a perspective view of the device of FIG. 1 in an opened state.

For example, as is shown in FIGS. 1A, 2 and 9, the inner surface 24 of the device 10, 10' preferably includes one or more projections 32. The projections 32 are preferably configured to engage portions of the fire-fighting/protection instrument frame work so as to restrain the instrument from moving within the chamber 26 formed by the device 10. As explained in greater detail below, the projections 32 contact portions of the frame arm and surrounding the frame arm to resist displacement of the instrument within the chamber 26 thereby minimizing impact upon the operational components of the instrument.

Figure 6A:
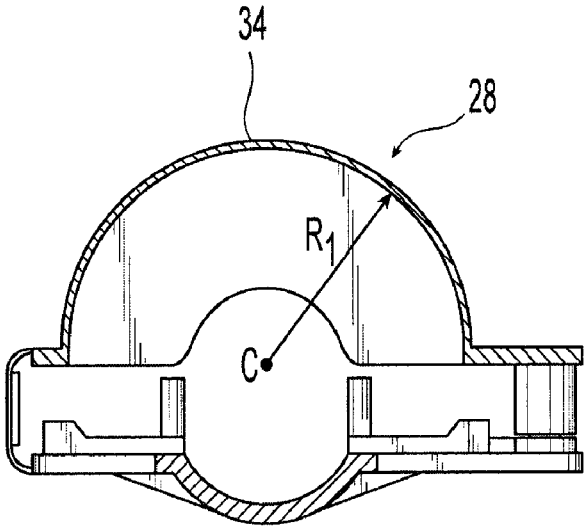
FIG. 6A is a cross-sectional view of the device of FIG. 2 cut along the line VIA-VIA.

The first wall portion 28 preferably includes a core element 34 preferably configured as a substantially curved wall to accommodate the operational components of the fire-fighting/protection instrument such as, the fusible link components, within the chamber 26. Even more preferably, the curved wall 34 defines a constant radius $R_1$ about a central axis of curvature C-C, as seen for example, in FIG. 6A so to further define a channel extending along the central axis C-C. The radius R1 defined by the curved wall relative to the axis of curvature C-C can range from about 0.5 in. to about one inch (1.0 in) and is preferably about 0.75 in. The core element 34 can include a wall portion of a different geometry in cross-section such as, for example, polygonal, oblong or multi-lobed, provided the wall can accommodate the operational components of the fire-fighting/protection instrument, and more preferably, can comply with the requisite impact performance characteristics of UL 1626, Section 35A; UL 199, Section 21 and/or UL 2351, Section 30.

Any one of the plurality of projections 32 disposed along the inner surface 24 of the wall member 20 can be located on the inner surface 24 of the curved wall 34. Preferably, the inner surface 24 of the curved wall 34 of the first portion 28 in the wall member 20 includes at least two projections 32*g*, as seen for example in FIG. 9, disposed about the axis of curvature C-C. More preferably the projections 32*g* are diametrically opposed about the central axis C-C. The projections 32*g* can be configured as rib members extending orthogonally from the inner surface 24. The ribs 32*g* could be configured to engage, for example, a portion of a fusible link assembly of a sprinkler located near the distal end 14 of the device 10 when the sprinkler is disposed within the chamber 26.

In a preferred embodiment of the device 10, the proximal end surface 16 is preferably contiguous with the curved wall 34 and even more preferably the distal end surface 18 is contiguous with the curved wall 34 so as to at least partially enclose the chamber 26 in the radial direction about the longitudinal axis A-A and in the longitudinal direction along the axis A-A. More preferably, the proximal end surface 16 and its intersection with the curved wall 34 define a common outer edge 36*a* of the device 10 as seen, for example, in FIG. 6. This common edge 36*a* preferably follows the curvature of the curved wall 34, and more specifically defines a curve having a constant radius relative to the center point C located along the axis of curvature C-C.

The proximal surface 16 further includes an interior edge 36*b* to bound the proximal end surface 16. Preferably the proximal end surface 16 includes a void 38 located between the outer edge 36*a* and the inner edge 36*b*. More preferably, the void 38 initiates from the inner edge 36*b* and extends toward the outer edge 36*a* so as to be located between the first portion 28 and the second portion 30 of the wall member 20. The void 38 is configured so as to permit the fire-fighting/protection instrument to extend from the chamber 26 through the proximal end 12 to an area external of the device 10, and more preferably surround the trigger assembly of the instrument. For example, as is shown in FIGS. 8 and 8A-8D, the trigger assembly can be substantially disposed within the chamber 26 and the yet extend from out of the void 38 to its junction with the deflector of the instrument located external and proximal to the device 10. The void 38 is further preferably configured such that a sufficient amount of surface area of the proximal end surface 16 is available to shield foreign matter from entering the chamber 26 and damaging the operational components of the fire-fighting/protection instrument.

The void 38 in the proximal end surface 16 is preferably configured as a slot having a substantially linear portion 38*a* initiating from the inner edge 36*b* terminating with a substantially circular portion 38*b*. The void 38 can be defined by any geometry provided the void permits communication between the chamber 26 and the external environment to the device 10 and further provides sufficient surface area along the proximal end surface 16 to shield and protect the operational components of the fire-fighting/protection instrument disposed within the chamber 26.

The distal end surface 18 is preferably configured to substantially mirror the proximal end surface 16 and substantially enclose the chamber 26 from the distal end 14 of the device 10. Shown in FIG. 7 is plan view of the distal end surface 18. More preferably the distal end surface 18 and its intersection with the curved wall 34 defines a common outer edge 35*a* of the device 10. This common edge 35*a* preferably follows the curvature of the curved wall 34, and more specifically defines a curve having a constant radius relative to the center point C located along the axis of curvature C-C.

The distal surface 18 further includes an interior edge 35*b* to bound the distal end surface 18. Preferably the proximal end surface 18 includes a void 37 located between the outer edge 35*a* and the inner edge 35*b*. More preferably, the void 37 initiates from the inner edge 35*b* and extends toward the outer edge 35*a* so as to be located between the first portion 28 and the second portion 30 of the wall member 20. The void 37 is configured so as to permit the fire-fighting/protection instrument to extend from the chamber 26 through the distal end 12 to an area external of the device 10. For example as seen in FIGS. 8 and 8A-8D, the trigger assembly can be substantially disposed within the chamber 26 and the yet extend from out of the void 37 to its junction with the closure assembly and the body of a sprinkler located external and distal to the device 10. The void 37 is further preferably configured such the a sufficient amount of surface area of the distal end surface 18 is available to surround the trigger assembly and shield foreign matter from entering the chamber 26 and damaging the operational components of the fire-fighting/protection instrument.

Accordingly, the void 37 formed in the distal end surface 18 is preferably semi-circular in shape preferably initiating from the inner edge 35*b*. The void 37 can alternatively be defined by any geometry provided the void permits communication between the chamber 26 and the external environment distal to the device 10 and further provides sufficient surface area along the distal end surface 18 to shield and protect the operational components of the fire-fighting/protection instrument disposed within the chamber 26. Preferably, the proximal and distal void 37, 38 are substantially axially aligned so as to provide openings, in communication with the chamber 26, from which the proximal and the distal ends of the instrument 100, 200, 300, 400 can extend.

Preferably, contiguous with the core element 34 are one or more lateral elements 40, 42 as seen, for example, in FIG. 1. Referring now to FIG. 1A, the hinge 26 and hinge axis B-B can be formed along the lateral element 42. In addition, the inner surface 24 along the lateral elements 40, 42 can present a surface that can further enclose and/or support portions of the fire-fighting/protection instrument within the chamber 26. In one preferred embodiment of the device 10, as seen for example in FIG. 7, at least one of the lateral elements 40, 42 is a substantially thin walled planar element contiguous with the core element 34 forming a preferably step transition when viewed from the device proximal and/or distal end. The substantially thin walled planar geometry of the lateral element 40, 42 can facilitate minimizing the overall volume of the device 10 such that the device 10 can effectively protect a fire-fighting/protection instrument and its operational components and yet avoid an over-sized protective covering that adds unnecessary bulk that makes handling, storage and/or transportation problematic.

The lateral element 40 further preferably includes a portion of a locking mechanism 44 for working with the other portion of the locking mechanism located on the second portion 30 of the wall member 20. The locking mechanism 44 is preferably configured for holding the device 10 in a closed position about a fire-fighting/protection instrument. More specifically, the locking mechanism preferably temporarily affixes the second portion 30 of the wall member to the first portion 28 and can further be unlocked to allow the second portion 30 to pivot about the pivot axis B-B and/or B'-B'. Preferably, the locking mechanism 40 is located at a maximum lateral distance from the pivot axis B-B to make use of the mechanical advantage available at such a maximum spacing.

The locking mechanism 44 and the hinge 26 are preferably configured for high cycling. In one preferred embodiment the locking mechanism is a snap fit mechanism that can be repeatedly latched and unlatched as needed without becoming loose over time to access the fire-fighting/protection instrument and/or the chamber 26 of the device 10. Preferably, the lateral element 40 includes a female receptacle configured to receive a male member, disposed on the second portion 30 of the wall member 20, in a snap fit fashion. To access the chamber 26 in order to, for example, dispose the device 10 about a fire-fighting/protection instrument, the male and female members can be separated and the first portion 28 pivoted with respect to the second portion 30 about the hinge axis B-B and/or axis B'-B'.

The second portion 30 can be configured generally similarly to the first portion 28 so as to include a central or core element 50 and one or more lateral members 46, 48, as shown in FIG. 1A. As noted above, the second portion 30 is preferably configured so as to include a portion of the locking mechanism 44 to complement the portion of the locking mechanism on the first portion 28. Preferably, the male portion of the snap fit locking mechanism 44 is disposed in the preferably substantially thin walled lateral member 46 for engagement with the female portion of the locking mechanism 44. Lateral member 48 is preferably configured to form the hinge 26' of the device 10 and more preferably form the living hinge about which the first and second portions 28, 30 can pivot relative to one another about axis B'-B'.

Figure 3:
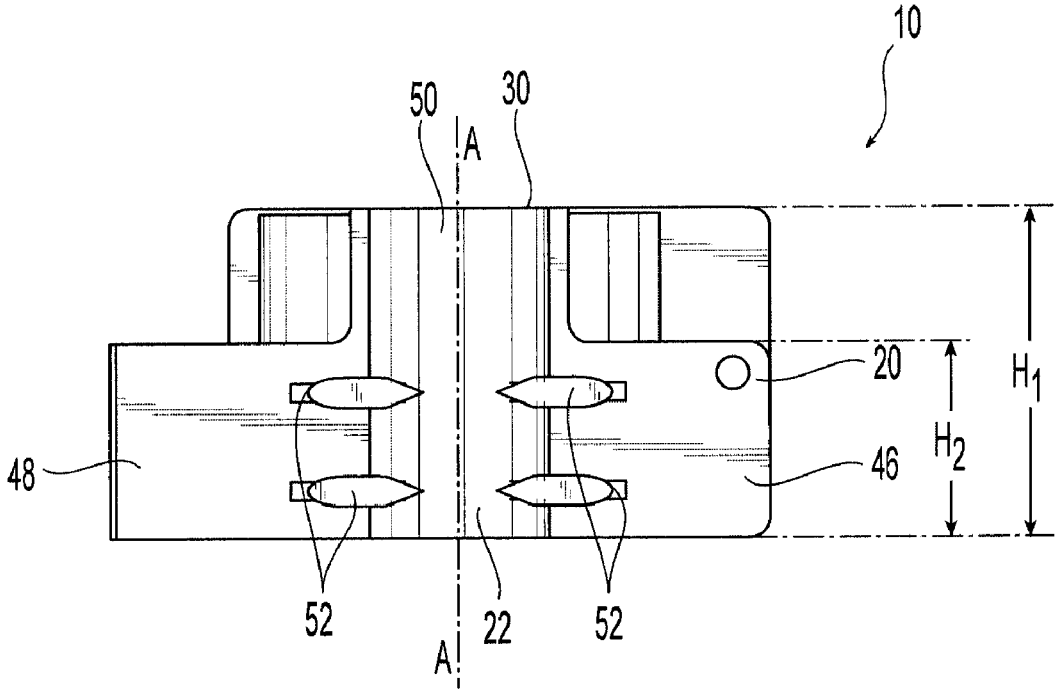
FIG. 3 is a plan view of the right side of the device of FIG. 1.
Figure 4:
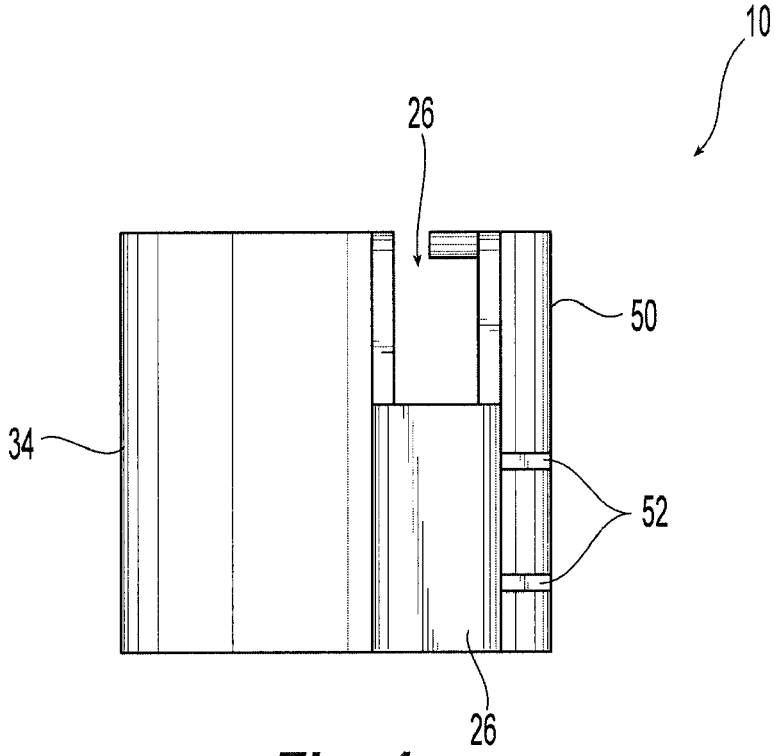
FIG. 4 is an end view of the device of FIG. 1.
Figure 5:
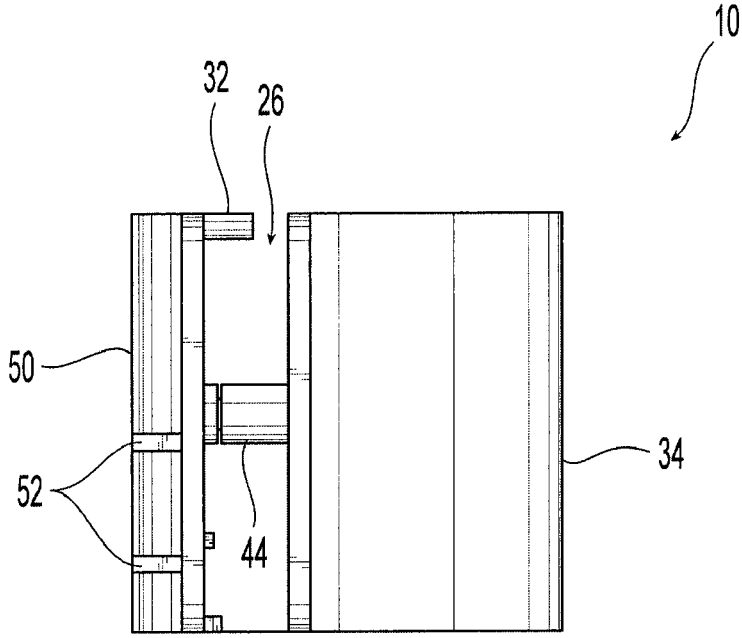
FIG. 5 is another end view of the device of FIG. 1.
Figure 6:
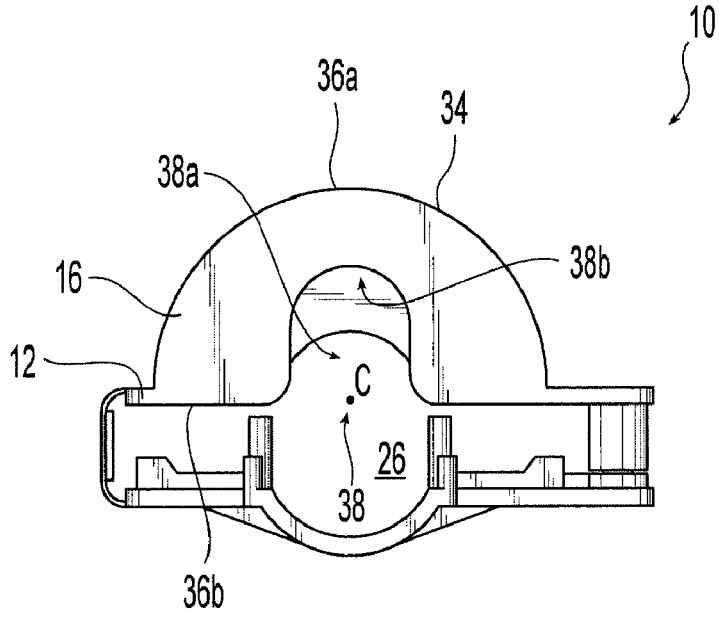
FIG. 6 is a top view of the device of FIG. 1.
Figure 8D:
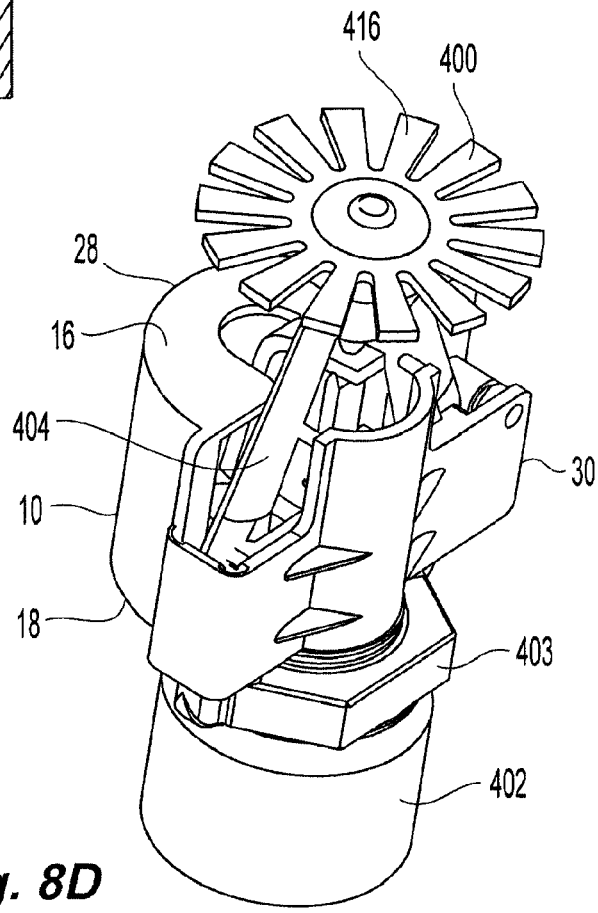

Preferably contiguous with the lateral members 46, 48 is the core element 50 disposed between the lateral members 46, 48. As is shown in FIG. 3, the core element 50 preferably defines a first wall height H1 in the direction of the longitudinal axis A-A, and at least one of the lateral members defines a second wall height H2 less than H1. Providing lateral members 46, 48 with a wall height H2 less than the core height H1 reduces unnecessary bulk in the device 10 and exposes aspects of the fire-fighting/protection instrument that can facilitate handling of the instrument while continuing to shield and protect the more fragile operational components. Moreover, the configuration of the wall heights and the overall compact nature of the device 10 can provide access to the tool engaging surfaces of the fire-fighting/protection instrument 100 such as, for example the hex-shaped multi-flat element 102 at the base of a sprinkler body 102 adjacent the trigger assembly and as is shown in FIG. 8 or FIG. 8D. Moreover, the varying heights of the wall member 20 provides access points to a sprinkler for use of a special wrench or other sprinkler installation tool without having to remove the cover and risk damage to the operational components of the sprinkler. Accordingly, the device 10 can remain disposed about an instrument such as a sprinkler 100, 200, 400 or nozzle 300 during the installation process and construction of the fire protection system. The device 10 can thus provide protection to the instrument's 100 operational components as construction of the fire protection system is on-going. Once the construction of the system is completed, the device 10 can be removed from the instrument 100 and the system can be placed in service.

Figure 7A:
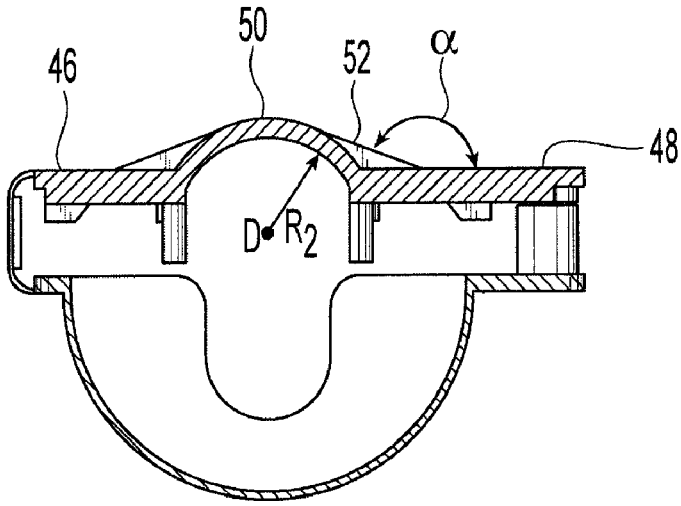
FIG. 7A is a cross-sectional view of the device of FIG. 2 cut along the line VIIA-VIIA.

The core element 50 of the second portion 30 is preferably a curved wall curved about an axis of curvature D-D such that that the inner surface 24 along the curved wall 50 forms a channel. The curved wall 50 is preferably configured to accommodate the operational components of the fire-fighting/protection instrument such as, for example, the thermally rated bulb type trigger assembly, within the chamber 26. Even more preferably, the curved wall 50 defines a constant radius $R_2$ about a central axis of curvature D-D, as seen for example, in FIG. 7A so to further define a channel extending along the central axis D-D. The radius R2 defined by the curved wall relative to the axis of curvature D-D can range from about 0.25 in. to about one-half inch (0.5 in) and is preferably about 0.37 in. Again to minimize the overall volume of the device 10, the radius $R_2$ curved wall 50 in the second portion 30 of the wall member 20 is preferably smaller than the radius $R_1$ of the curved wall 34 in the first portion 28 of the wall member 20. The radius $R_2$ can be smaller provided where the curved wall 50 abuts a low profile spray nozzle operational element like a bulb or the axially extending member in the trigger assembly. Preferably, the radii define a ratio $R_1$:$R_2$ of about 2:1. The second wall portion 30 can include a core element 50 of a different geometry in cross-section such as, for example, polygonal, oblong or multi-lobed, provided the wall accommodates the operational components of the fire-fighting/protection instrument and complied with the requisite impact performance characteristics of UL 1626, Section 35A; UL 199, Section 21 and/or UL 2351, Section 30.

To provide additional strength characteristics to the device 10 for compliance with the impact performance standards such as, for example UL 1626, the outer surface 22 of the second portion 30 can include one or more reinforcement members 52 preferably disposed between the core element 50 and the lateral members 46, 48. The reinforcement members 52 can be in the form of a gusset having an edge defining a tangent relative to the core element or curved wall 50 and further defining an included angle α ranging from of about 120° to about 160° relative to the substantially planar lateral members 46, 48 and is preferably 120°. Alternatively, the reinforcement member can be any formed thickening of the wall member between the core element 50 and the lateral members 46, 48.

Figure 1B:
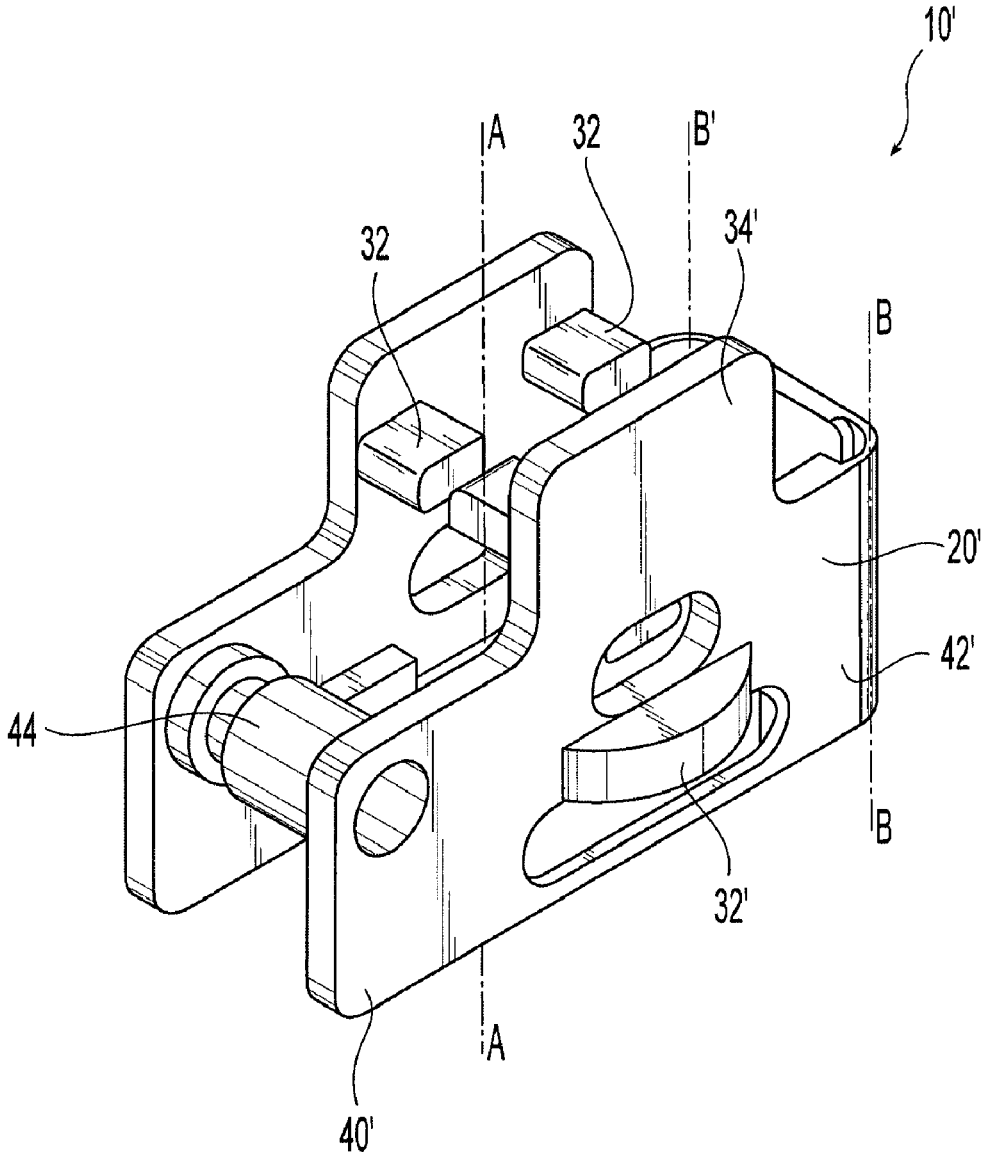
FIG. 1B is another embodiment of the protective cover device.

The outer surface 22 of the device 10 can include additional projections to provide adequate impact resistance. For example, as seen in the alternative embodiment of the device 10' shown in FIG. 1B, a lobed projection 32' can be provided about the outer surface of core element 34' and substantially centrally disposed about the lateral members 40', 42' of the wall member 20'. The lobed projection 32' is preferably configured to add additional stiffness to the structure while maintaining the overall compact profile of the device 10. The lobed projection 32' of the device 10' is further preferably configured to deflect and absorb impact forces that might otherwise damage the operational components of the fire-fighting/protection instrument disposed therein. The overall height and size of the projection 32' can be configured to maintain the compact profile of the device 10' so that installation tools can continue to access the fire-fighting/protection instrument without the need to remove the device 10'.

As previously noted the protective cover device 10 preferably includes one or more projections 32 along the inner surface 24 of the wall member 20 to engage, support and/or restrain movement of the fire-fighting/protection instrument within the device 10. As seen, for example at FIG. 9, shown is the device 10 in an opened state with a plurality of projections 32 located throughout the inner surface 24. The projections 32 are located throughout the inner surface such that the device 10 can be disposed about and effectively provide protection for a variety of instrument configurations.

Accordingly, the device 10 can include projections 32*a*, 32*b* disposed preferably about the proximal end of the device 10. These proximal end projections 32*a*, 32*b* are more preferably disposed about the preferably curved wall 50 of the second portion 30 of wall member 20. The projections 32*a*, 323*b* can be configured and located so as to engage, for example the space located between the frame arms 304 and the bulb type trigger assembly 310 in the illustrative bulb type spray nozzle of FIG. 11. The projections 32*a*, 32*b* are preferably substantially circular cylindrical in shape having a length preferably of about 0.1-0.2 inches and preferably is about 0.13 inches. Alternatively, the projections 32*a*, 32*b* can be rectangular or any other shape in cross-section. The projections 32*a*, 32*b* preferably have a diameter of about 0.05-0.1 inches and is preferably about 0.08 inches.

Distal of the projections 32*a*, 32*b* are preferably cylindrical projections 32*c*, 32*d*, also disposed about the curved wall 50 of the second portion 30 of the wall member 20. The projections 32*c*, 32*d* can be preferably located to engage for example, the tabs 307*a*, 307*b* of the frame arms 304 in the spray nozzle 300 of FIG. 11. Alternatively, the projections can engage the frame arms 204 or the space in between the frame arms 204 and the link assembly 210 in the sprinkler 200 of FIG. 10. The projections 32*c*, 32*d* are preferably substantially circular cylindrical in shape having a length preferably of about 0.25-0.5 inches and preferably is about 0.3 inches. The projections 32*c*, 32*d* preferably have a diameter of about 0.05-0.2 inches and is preferably about 0.1 inch.

Disposed laterally to each side of the projections 32*c*, 32*d* are projections 32*e*, 32*f*. Preferably, projections 32*e*, 32*f* are disposed along the lateral members 46, 48. The projections 32*e*, 32*f* are preferably multifaceted members presenting surfaces at variable elevations relative to the inner surface 24. Preferably, the projections 32*e*, 32*f* include one or more facets configured to engage the surface of the frame arms of a sprinkler disposed in the chamber 26 of the device 10. Engagement of the projections 32*e*, 32*f* with the surface of, for example, frame arms 204 or 304 of sprinklers 200, 300, 400 respectively can substantially restrain relative movement between the instrument 100, 200, 300, 400 relative to the device 10 when disposed therein. The projections 32*e*, 32*f* can respectively include an angled facet 32*i*, 32*k* angled relative to the plane of the inner surface 24 to define an angle of about 55°. The angled facet can act as a wedge member against the surface of the sprinkler frame arms.

The inner surface 24 can include additional projections 32*g* disposed on either the first or second portions 28, 30 of wall member 20. The projections 32*g* are preferably planar projections extending from the inner surface 24. The projections are preferably located proximal of the distal end of the device 10 and are more preferably configured to engage the frame arm surfaces of the instrument. For example, the projections 32*g* disposed within the channel of the curved wall 34 of the first portion 28 are preferably located to engage a boss 205*a*, 205*b* on the frame arms 204. Alternatively, the projections 32*g* can engage the outer surfaces of the frame arms 204, 404 of a sprinkler 200, 400 or a the frame arms 304 of a spray nozzle 300 to securely support the instrument within the chambers 26 of the device 10.

It should be understood that the geometry and the location of the projections 32 can be configured and added to the inner surface 24 so as to accommodate varying fire-fighting/protection instrument configurations in a manner that will support the instrument in the chamber 26. In addition the projections 32 can be configured such that they effectively protect the operational components of the fire-fighting/protection instrument at least in accordance with the impact requirements of UL 1626, Section 35A; UL 199, Section 21 and/or UL 2351, Section 30.

The preferred embodiment of the 10 preferably complies with the impact test standards of UL 1626, Section 35A; UL 199, Section 21 and/or UL 2351, Section 30. In a UL test report, File Ex2003 (rev. issued Feb. 28, 2005) (hereinafter "File Ex2003") it was indicated that the device 10 preferably embodied as "Model TY-04 protective cover" successfully passed the impact test for protective covers under UL 2351, 2d ed., Section 30. File Ex2003 is incorporated herein by reference.

While the present invention has been disclosed with reference to certain preferred embodiments, numerous modifications, alterations, and changes to the described embodiments are possible without departing from the sphere and scope of the present invention. Accordingly, it is intended that the present invention not be limited to the described embodiments, but that it have the full scope defined by the language of the following claims, and equivalents thereof.

What is claimed is:

1. A protection device for a fire protection instrument, the protection device comprising:

a proximal end and a distal end spaced from the proximal end along a longitudinal axis;

a wall member having an outer surface and an inner surface circumscribed about the longitudinal axis, the wall member including a first portion and a second portion defining at least one pivot axis therebetween, the inner surface including a plurality of projections for supporting the instrument, at least one of the first and second portions further defining a core element disposed between a first lateral member and a second lateral member;

the proximal end including a proximal end surface contiguous with at least one of the first and second portions of the wall member, the distal end including a distal end surface contiguous with at least one of the first and second portions of the wall member, the proximal and distal end surfaces radially extending in the direction of and substantially orthogonally to the longitudinal axis so as to define a chamber with the wall member for housing at least a portion of the protection instrument, at least one of the plurality of projections being located between the proximal end surface and the distal end surface.

2. The device of claim 1, further comprising a living hinge disposed along the at least one pivot axis.

3. The device of claim 1, wherein at least one of the proximal and distal surfaces includes an edge defining a void, in communication with the chamber.

4. The device of claim 3, wherein each of the proximal and distal surfaces includes an edge defining a respective void, the void of the proximal surface and the void of the distal surface being axially aligned with one another and in communication with the chamber.

5. The device of claim 4, wherein each of the voids has a linear portion and an arcuate portion in communication with the linear portion.

6. The device of claim 1, wherein the inner surface along the core element has at least one pair of projections radially disposed along the longitudinal axis.

7. The device of claim 1, wherein the core element of the at least one of the first and second portions of the wall member includes an axially extending curved portion.

8. The device of claim 1, wherein the at least one of the first and second portions of the wall member includes at least one reinforcement member disposed between the core element and one of the first and second lateral member.

9. The device of claim 8, wherein the reinforcement member is a gusset disposed along the outer surface of the wall member.

10. The device of claim 9, wherein the one of the first and second lateral members is substantially planar, the gusset defining an included angle ranging from about one hundred and twenty degrees (120) to about one hundred and sixty degrees (160) with the lateral member.

11. The device of claim 1, wherein the core element defines a first wall height and one of the lateral members defines a second wall height, the first wall height being greater than the second wall height.

12. The device of claim 1, wherein the inner surface of the second portion includes a plurality of projections including at least a pair of projections disposed about a channel for engaging a portion of the sprinkler.

13. The device of claim 1, wherein at least one of the plurality of projections includes a plurality of surfaces defining elevations from the inner surface that vary from one another.

14. The device of claim 13, wherein the plurality of surfaces include at least two surfaces angled relative to one another.

15. The device of claim 1, wherein the wall member includes a locking mechanism to affix the first portion of the wall member relative to the second portion of the wall member, the locking mechanism having a first locking element and a second locking element configured to mate with the first locking element.

16. The device of claim 15, wherein the locking mechanism comprises a snap fit locking mechanism, wherein the locking mechanism including a projection having an enlarged tip extending from the inner surface of the first portion and a receiving bore extending from the inner surface of the second portion to receive the projection therein.

17. The device of claim 15, wherein the locking mechanism is located along the wall member so as to define a maximum spacing between the locking mechanism and the pivot axis.

18. A fire protection system comprising:

an instrument having a deflector and a body axially spaced from the deflector along an instrument axis, the instrument body including a pair of frame arms disposed about the instrument axis, and a trigger assembly disposed between the frame arms; and a protective device disposed about the trigger assembly, the device including:

a wall member having an outer surface and an inner surface circumscribed about the instrument axis, the wall member including a first portion and a second portion defining at least one pivot axis therebetween, the inner surface including at least two projections engaged with a portion of the frame arms so as to substantially prevent relative movement between the protective device and the instrument; at least one of the first and second portions of the wall member further defining a core element disposed between a first lateral member and a second lateral member;

a proximal end surface contiguous with at least one of the first and second portions of the wall member, a distal end surface contiguous with at least one of the first and second portions of the wall member, the proximal and distal end surfaces radially extending in the direction of and substantially orthogonally to the longitudinal axis so as to define a chamber with a wall member for housing at least a portion of the trigger assembly, at least one of the at least two projections being located between the proximal end surface and the distal end surface.

19. A method of protecting a fire-fighting instrument having a frame and a trigger assembly disposed within the frame, the method comprising:

disposing a protective device having a wall member including a first portion and a second portion, the wall member having an inner surface, about the trigger assembly;

engaging a plurality of projections disposed along the inner surface with a portion of the frame of the instrument so as to substantially eliminate relative movement between the protective device and the instrument; and radially extending a proximal surface and a distal surface from the wall member toward and substantially orthogonally to the trigger assembly, such that at least one of the plurality of projections is located between the proximal surface and the distal surface so as to house the trigger assembly within a chamber.

20. The protection device of claim 1, wherein each of the first and second portions define a core element, the first portion defining a first core element and the second portion defining a second core element, the first core element being defined by a first curved wall defining a constant radius of curvature R1, the second core element being defined by a second curved wall defining a constant radius of curvature R2, R2 being smaller than R1.

* * * * *